US007010873B2

(12) United States Patent
Kinoshita et al.

(10) Patent No.: US 7,010,873 B2
(45) Date of Patent: Mar. 14, 2006

(54) CONTINUOUS UNDERGROUND TRENCH EXCAVATING METHOD AND EXCAVATOR THEREFOR

(75) Inventors: Fumio Kinoshita, Tokyo (JP); Motohiko Mizutani, Akashi (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 12 days.

(21) Appl. No.: 10/645,543

(22) Filed: Aug. 22, 2003

(65) Prior Publication Data

US 2004/0148818 A1 Aug. 5, 2004

(30) Foreign Application Priority Data

Aug. 30, 2002 (JP) ..... 2002-253182

(51) Int. Cl.
*E02F 3/08* (2006.01)

(52) U.S. Cl. ..... 37/352; 37/906; 37/462

(58) Field of Classification Search ..... 37/352, 37/462, 906, 353, 347, 348, 382, 189, 465; 172/2; 701/50; 405/267
See application file for complete search history.

(56) References Cited

U.S. PATENT DOCUMENTS 3,893,302 A * 7/1975 Peterson ..... 405/267
4,681,483 A * 7/1987 Camilleri ..... 405/267
5,561,923 A * 10/1996 Kitanaka ..... 37/352
6,139,225 A * 10/2000 Koike et al. ..... 405/267
6,219,945 B1 * 4/2001 Heishi et al. ..... 37/358
6,354,026 B1 * 3/2002 Trevisani ..... 37/355
6,381,882 B1 * 5/2002 Mizutani et al. ..... 37/462
6,470,607 B1 * 10/2002 Taki ..... 37/352
6,508,608 B1 * 1/2003 Nilson et al. ..... 405/128.5
6,536,142 B1 * 3/2003 Mizutani et al. ..... 37/352
6,574,893 B1 * 6/2003 Mizutani ..... 37/462

FOREIGN PATENT DOCUMENTS

JP 63-130833 * 6/1988
JP 11-280055 10/1999

* cited by examiner

*Primary Examiner*—Victor Batson
(74) *Attorney, Agent, or Firm*—Oblon, Spivak, McClelland, Maier & Neustadt, P.C.

(57) ABSTRACT

This invention provides with a continuous underground trench excavating method and an excavator for the method, which performs vertical excavation in which a trencher of the excavator is inserted into the ground and horizontal excavation in which a travel body of the excavator is moved substantially horizontally, characterized in that it determines a penetration resistance under penetration of the trencher to a predetermined depth, estimates a ground strength in the underground depth direction on the basis of the penetration resistance, and a continuous underground trench excavating is carried out with a thrust matching the estimated ground strength, whereby capable of carrying out an appropriate excavation with better understanding of the ground condition.

11 Claims, 4 Drawing Sheets

CONTINUOUS UNDERGROUND TRENCH EXCAVATING METHOD AND EXCAVATOR THEREFOR

BACKGROUND OF THE INVENTION

1. Field of the Invention

This invention relates to a continuous underground trench excavating method and an excavator therefor to form a continuous underground wall.

2. Description of the Related Art

TRD (Trench-cutting Re-mixing Deep Wall) method is known as creation method for continuous underground wall. In a case of creating a water stop wall or an earth retaining wall under the ground deeply, it is extremely important to control whether or not an excavating machine reaches an impermeable layer or a supporting foundation.

Generally, as boring data by drilling survey are limited to a certain work site where the survey is executed actually, however, in case that there exist lot of changes on the condition of layer of earth, it depends on erroneous assumption whether or not a lower end of an excavating machine reaches an impermeable layer or a supporting foundation. Accordingly, as it is, excessive excavation has to be carried out up to a depth where the lower end thereof could reach the impermeable layer absolutely even if the changes exist.

As a result, it gives rise to not only more costly execution but also unnecessary delay in construction schedule. If things come to the worst, completion comes to miss the fixed deadline.

According to a method of improving the ground as described in Japanese Patent Application publication No. Hei 11-280055, a stirring stick with a stirring wing mounted on the end thereof is inserted vertically into the ground with mixing action up to a predetermined depth and then the stick is lifted up while an improving material is poured from the end and the mixing action of the stick is carried out, thereby an improved ground is formed. In this case, when there exist lot of changes on the condition of layer of earth, it also depends on the above erroneous assumption since the boring data do not represent all the ground to be excavated.

SUMMARY OF THE INVENTION

The present invention has an object to provide a continuous underground trench excavating method and an excavator therefor capable of excavating a required underground trench effectively while assuming the change of the ground condition accurately.

A continuous underground trench excavator of the present invention comprises a trencher having an excavating element, a travel body adapted to support the trencher vertically movably, the travel body causing the trencher to move substantially vertically and substantially horizontally to form a continuous trench, a penetration resistance calculating means for calculating a penetration resistance under penetration of the trencher to a predetermined underground depth, a ground strength estimating means for estimating a ground strength in a direction of the underground depth from the penetration resistance, and an excavation control means for making control so that excavation is carried out with a thrust matching the estimated ground strength. The trencher acts as excavating device capable of digging the trench.

According to the present invention, an appropriate and effective excavation can be carried out with better understanding of the ground condition.

Furthermore, it is preferable to additionally provide the excavator with an excavation energy calculation means for calculating excavation energy for unit depth on the basis of the penetration resistance.

In this case, the ground strength estimating means can estimate the ground strength from the excavation energy. An excavation which meets an excavation capacity of the excavator can be carried out since the ground strength is calculated from the excavation energy.

DESCRIPTION OF THE PREFERRED EMBODIMENTS

A continuous underground trench excavating method and an excavator for the method according to an embodiment of the present invention is described hereinafter with reference to FIGS. 1 to 4. It is to be understood that the invention is not limited only to the following embodiment.

Figure 1:
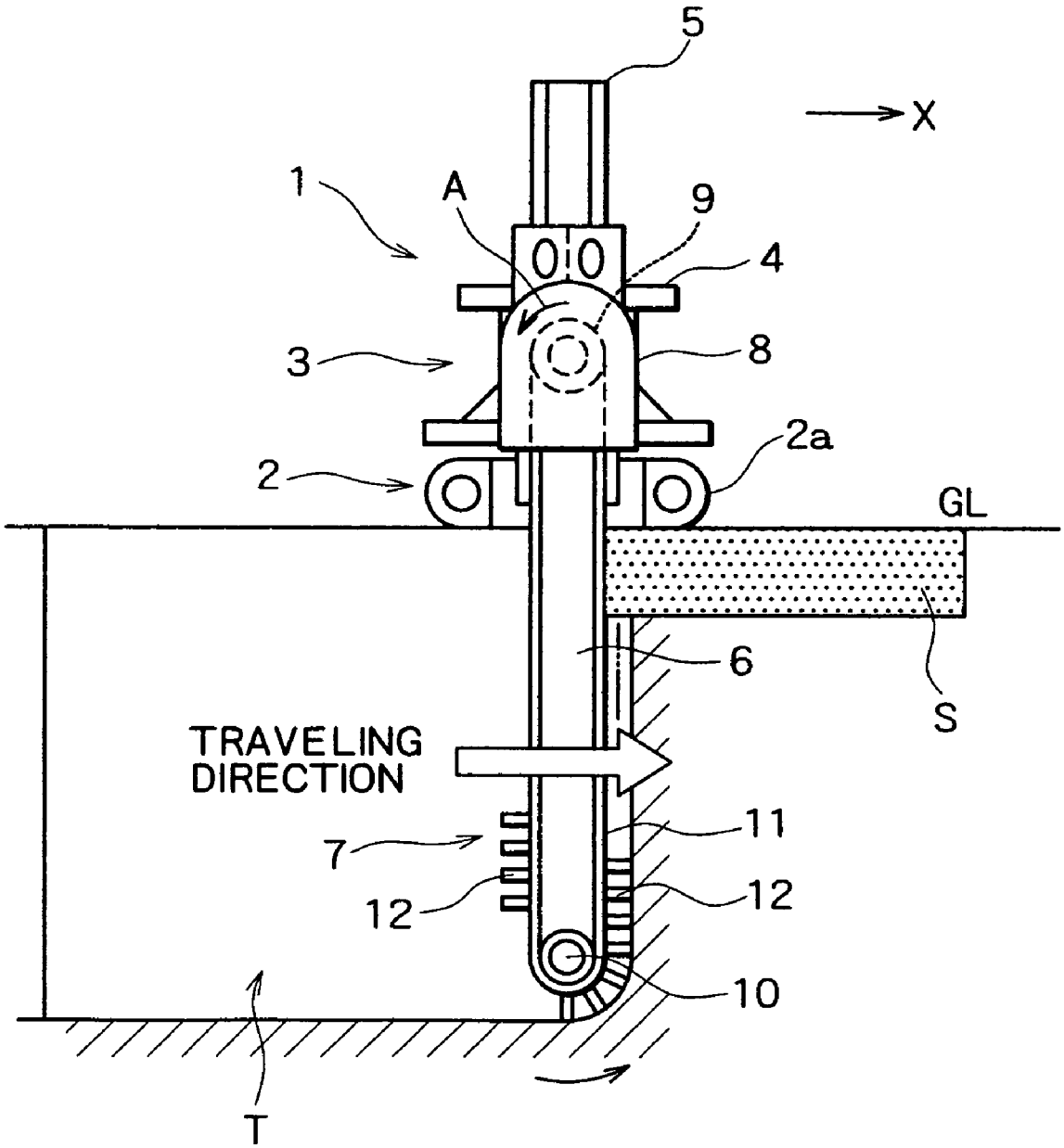
FIG. 1 is a front view of a trench excavation by a continuous underground trench excavator according to an embodiment of the present invention.

FIG. 1 illustrates a construction of a continuous trench excavator used in an underground continuous trench excavating method according to the present invention.

A continuous trench excavator 1 comprises a lower travel body 2 and an upper rotating body 3 mounted rotatably thereon. A gate-like or gantry frame 4 is attached to the lower travel body 2. The lower travel body 2 is equipped with a crawler 2*a* as a base machine for travel on the ground.

In the gate-like frame 4 are arranged a pair of upper transverse cylinder and lower transverse cylinder (neither shown) in parallel with each other vertically. With both cylinders, a thrust for transverse excavation is imparted to a cutter post 6 suspended from a leader 5 and serving as a trencher. With the cutter post 6 as a guide, a cutter chain 7 as an excavating element rotates around the cutter post to carry out excavation. The lower travel body as a traveling means supports the cutter post 6 indirectly so that the cutter post can move substantially vertically.

The cutter post 6 is constituted by jointing each long box-shaped frame. A driving wheel 9 rotates by means of a rotation drive unit 8 mounted at an upper end of the post 6. An endless chain 11 of a cutter chain 7 is stretched and entrained on between the driving wheel 9 and an idler wheel 10 mounted at a lower end of the cutter post 6. A large number of excavating bits 12 are arranged on an outer periphery side of the chain 11 through a bit plate. The rotation drive unit 8 is movable up and down by means of a lift cylinder disposed in the leader 5.

The cutter post 6 is moved transversely (in the arrow X direction) while being pushed against the ground under operation of the cutter chain 7 to excavate a trench T in the advancing or traveling direction of the cutter post.

Excavating liquid is discharged from a discharge port formed in the lower end of the cutter post 6 to assist excavation of the trench T. Alternatively, ground solidifying liquid is discharged from the discharge port and is mixed and stirred with excavated soil, etc. to form a continuous soil cement wall.

As methods for trenching and for the formation of a soil cement wall, one-pass method, two-pass method, and three-pass method are available. One of these methods is selected suitably according to execution conditions. According to the one-pass method, both trenching and formation of a soil cement wall are carried out simultaneously. In this one-pass method, solidifying liquid is poured while excavation is carried out by the cutter post 6. (An advance side corresponds to a state of excavation, while a rear side corresponds to a state of formation of a soil cement wall.)

According to the two-pass method, after the excavation of the trench T is over or an approach route, the cutter post 6 is moved along a return path or backhaul while pouring solidifying liquid to form a soil cement wall along the trench T.

According to the three-pass method, after the excavation of the trench T is over or an approach route, the cutter post 6 is moved again to an excavation start point and is further moved along a return path or backhaul while pouring solidifying liquid to form a soil cement wall along groove T formed.

Figure 2:
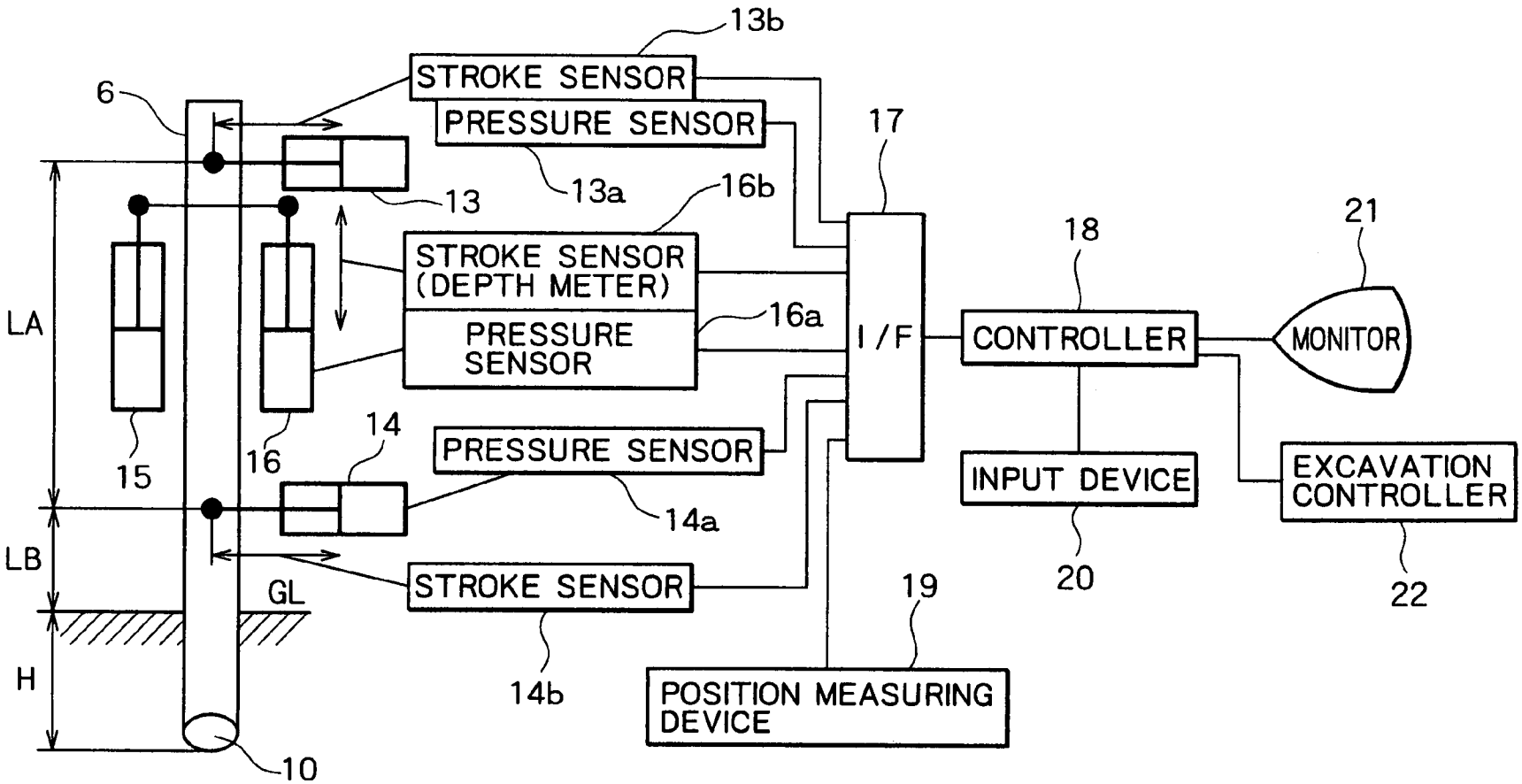
FIG. 2 is a block diagram showing how a trench excavation is controlled in the embodiment.

FIG. 2 is a block diagram illustrating how trenching is controlled.

In the cutter post 6 are arranged an upper transverse cylinder 13 and a lower transverse cylinder 14 in parallel with each other. With a thrust of the lower transverse cylinder 14, the cutter post 6 can be pushed against the ground. The upper transverse cylinder 13 generates a cylinder holding force in a direction opposite to the pushing force of the lower transverse cylinder 14.

The upper transverse cylinder 13 is provided with a pressure sensor 13*a* for detecting an operating pressure and a stroke sensor 13*b* for detecting a cylinder stroke. Likewise, the lower transverse cylinder 14 is provided with a pressure sensor 14*a* and a stroke sensor 14*b*.

One of lift cylinders 15 and 16 for moving the cutter post 6 up and down, the cylinder 16 in the FIG. 2, is provided with a pressure sensor 16*a* and a stroke sensor 16*b*. The stroke sensor 16*b* functions as a depth meter.

Pressure signals and stroke signals detected by the sensors are applied to a controller 18 through an interface 17.

A position measuring instrument 19 measures an excavating position and provides the excavating position as the result of the measurement to the controller 18. For example, the position measuring instrument 19 is composed of a GPS (Global Positioning System) or an automatic tracking distancemeter.

Other than these sensors, an input device 20, which is constituted by a keyboard and so on, is connected to an input side of the controller 18, whereby various commands and excavating conditions can be inputted.

A monitor 21 constituted, for example, by a liquid crystal display is connected to an output side of the controller 18. The monitor 21 displays, as guidance display, the setting of excavating conditions and contents of excavation on the screen and also displays the state of excavation graphically during excavation.

The controller 18 outputs an excavation command to an excavation controller 22. For example, the excavation controller 22 controls the transverse cylinders 13 and 14 to generate a thrust which matches the ground strength, or controls the lift cylinders 15 and 16 for adjusting an excavation depth. The controller 18 comprises a penetration resistance calculating means, an excavation energy calculating means, a ground strength estimating means, and an excavation control means. The controller 18 can execute these functions in accordance with the following procedure.

Next, a description is given below about the operation of the continuous trench excavator 1 and the control made by the controller 18.

The control made by the controller 18 goes through the following three steps in order.

Step A: a processing for obtaining N value.

Step B: a processing for deriving an estimated transverse speed in horizontal excavation.

Step C: a processing for measuring a load change in horizontal excavation.

Each of the steps is described below in detail.

[Step A]

An N value of the ground to be actually excavated is estimated by carrying out excavation in a vertically downward direction.

Procedure 1: Calculating a Penetration Resistance Fz

When a self-penetration work is carried out, the controller 18 gets a load Fud imposed on the lift cylinder 16 from the pressure sensor 16*a* attached to the lift cylinder 16.

On the other hand, an operator measures a liquid specific gravity γ around the cutter post by sampling muddy water and inputs the result of the measurement from the input device 20.

The controller 18 calculates a cutter post volume V in an underground portion. Given that a unit depth post volume is c and an excavation depth is H, the cutter post volume V is determined by the following equation (1):

$$V=cH \tag{1}$$

Next, a total mass W of the rotation drive unit 8 attached to the lift cylinder 16, the cutter post 6, etc. is calculated.

A penetration resistance Fz is calculated from the following equation (2):

$$Fz[kN]=W-Fud-\gamma V-Ffz \tag{2}$$

A value of Fud stands for a lift cylinder load, which a lift side thereof is assumed to be positive and a penetration side thereof negative. A value of Ffz stands for a frictional resistance in a vertically downward direction and is determined from the following equation (3) by operating the lift cylinders 15 and 16 in an unlanded, floating state in the air:

$$Ffz=W-Fud-\gamma V \tag{3}$$

The penetration resistance Fz (>0) is calculated as Fzi [kN] (>0) at every constant sampling.

Procedure 2: Calculating Excavation Energy Required for Unit Depth

The following processing is performed for the penetration resistance Fzi determined at every sampling time. In the case where the sampling time is 1/n [min], a value of Fzi is divided by n, followed by cumulation n times. The result is used as a mean value Fzj [kN/min] for a period of one minute.

By cumulative calculation of the mean value Fzj for a time T (=L/v) [min] necessary for excavating a unit depth L [m], there is obtained a value of FzL [kNm].

A value of Fzl obtained in case of L [m] being 1 [m] is assumed to be excavation energy required for unit depth.

Procedure 3: Calculating an Estimated Conversion N Value

An N value is converted from a relation (the following equation (4)) between the estimated converted N value and the excavation energy Fzl for unit depth.

$$\text{Converted } N \text{ value}=aFzl \tag{4}$$

Where, a value of "a" stands for a proportional constant, which is determined on the basis of actual results as actual performance and boring data by drilling survey in an actual work site.

Symbols to be used in the following description are defined as follows.

Ez: excavation energy necessary for vertical excavation

Ex: excavation energy necessary for transverse excavation

If excavation volumes are equal to each other, it is basically assumed that Ez=Ex.

Fz: average load (actual value) in the vertical direction

Sz: vertical sectional area (calculated value)

Rx: average load in the transverse direction (calculated from an excavation depth)

Sx: transverse sectional area (calculated value)

[Step B]

An estimated transverse speed in horizontal excavation is calculated by excavation in a vertically downward direction.

Procedure 4: Values Obtained on an Excavation in a Vertically Downward Direction Excavation energy Fzl is all cumulated from 0 m to an excavating depth to obtain a total excavation energy FzH.

An average vertically downward excavation speed Vzav [m/min] is obtained by the following equation (5) from both time T required for excavation of all depths and the excavating depth H:

$$Vzav=H/T \tag{5}$$

Likewise, an average penetration resistance Fzav [kN] in a vertically downward direction is determined by the following equation (6):

$$Fzav=FzH/H \tag{6}$$

Procedure 5: Calculating an Average Depth Under a Horizontal Ground Reaction

A value of a moment is calculated by the following equation (7) from the estimated conversion N values at various depths obtained in the Procedure 3 and then a ground reaction average depth is determined:

$$Hav=\Sigma N[i]\cdot h[i]/\Sigma N[i] \tag{7}$$

where, Hav: ground reaction average depth (in transverse excavation)

N[i]: N value at each depth h[i]: each depth (0~H [m])

Under the conditions shown in the following Table 1, Hav is 4.211 [m].

| Depth h[m] | N value | N value × h[m] | |
|---|---|---|---|
| 1 | 1 | 1 | |
| 2 | 2 | 4 | |
| 3 | 5 | 15 | |
| 4 | 10 | 40 | |
| 5 | 20 | 100 | |
| Σ | 38 | 160 | 4.211 |

Procedure 6: Calculating an Average Ground Reaction Force Fxav

A maximum thrust of the transverse cylinders in the horizontal direction is assumed to be FpLmax which is determined by machine specification.

A mounting spacing between the upper transverse cylinder 13 and the lower transverse cylinder 14 in the horizontal direction is assumed to be LA which is determined by machine specification (see FIG. 2). A height of the lower transverse cylinder 14 from the ground is assumed to be LB which is determined by machine specification.

An average ground reaction force Fxav in the horizontal direction is determined by moment calculation in accordance with the following equations (8) and (9):

$$FpLmax\times LA=Fxav\times(Hav+LB) \tag{8}$$

$$Fxav\ [kN]=FpLmax-LA/(Hav+LB) \tag{9}$$

Procedure 7: Calculating a Projected Excavation Area in a Vertically Downward Direction and a Projected Excavation Area in Horizontal Excavation A projected excavation area Sz in a vertically downward direction is determined by the following equation (10):

$$Sz=Bcp\ \text{(width of the cutter post)}\times B\ \text{(excavation width)} \tag{10}$$

A projected excavation area Sx in the horizontal direction is determined by the following equation (11):

$$Sx=H\ \text{(excavation depth)}\times B\ \text{(excavation width)} \tag{11}$$

Procedure 8: Calculating an Estimated Speed in Horizontal Excavation

Assuming that a surface pressure, or a contact pressure, is proportional to the excavation speed, the following relation as shown in the following equation (12) is established from the Procedures 5, 6, and 7:

$$Vxav:Vzav=Fxav/Sx:Fzav/Sz=Fxav\times Bcp:Fzav\times H \tag{12}$$

The following equation (13) is derived from the equation (12):

$$Vxav=Vzav\times Fxav\times Bcp/(Fzav\times H) \tag{13}$$

[Step C]

A load change in horizontal excavation is calculated.

Procedure 9: Calculating a Ground Reaction Force in Horizontal Excavation

A thrust FpL (absolute value) of the lower transverse cylinder in horizontal excavation is measured by the pressure sensor 14*a*.

A thrust FpU (absolute value) of the upper transverse cylinder in horizontal excavation is measured by the pressure sensor 13*a*.

A ground reaction force Rx is determined by the following equation (14):

$$Rx=FpL-FpU \tag{14}$$

Procedure 10: Calculating Excavation Energy for Unit Horizontal Distance

A value of a horizontal ground reaction force Rxi is derived at every sampling time.

More specifically, if the sampling time is 1/n [min], Rxi is divided by a value of n and cumulation is performed n times, whereby Rxj [kN/min] is assumed to be a mean value for a period of one minute.

Rxj is subjected to cumulative calculation for a time T (=L/V) [min] necessary for excavating a unit horizontal distance L [m] to obtain a value of Rxl [kNm].

With L [m] equal to 1 [m], Rxl is assumed to be excavation energy for each unit distance.

Procedure 11: Controlling Excavation Step According to a Load Change

The excavation energy Rxl for unit horizontal distance in the Procedure 10 is updated with moving average in unit of 0.1 [m] for example and Rxl value is displayed to let an operator recognize a load change.

From the calculation of Rxl, an average depth Hav under a ground reaction force can also be calculated by the following equation (15):

$$Hav=FpL\times LA/Rxl-LB \quad (15)$$

The value of Rxl and that of Hav are regarded as evaluation indices of a ground change.

The excavation controller 22 adjusts the depth automatically so that the value of Rxl is almost constant at all times.

In the case where the lower end of the cutter post 6 is inserted into a bearing layer or a supporting layer such as a water-impermeable layer or a bearing ground and excavation is performed in the horizontal direction, the lower end of the cutter post 6 is controlled in a direction of a depth so that the value of Rxl is within a predetermined range. By so doing, even where the level of the bearing layer varies vertically, the depth of the cutter post 6 inserted into the bearing layer can be held almost constant, following the level of the bearing layer. Consequently, it is possible to effect landing control.

When the value of Rxl is deviated from a predetermined range, the excavation controller 22 makes adjustment for excavation such as changing the inclination of the cutter post 6 or changing the cutter chain traveling direction.

Figure 3:
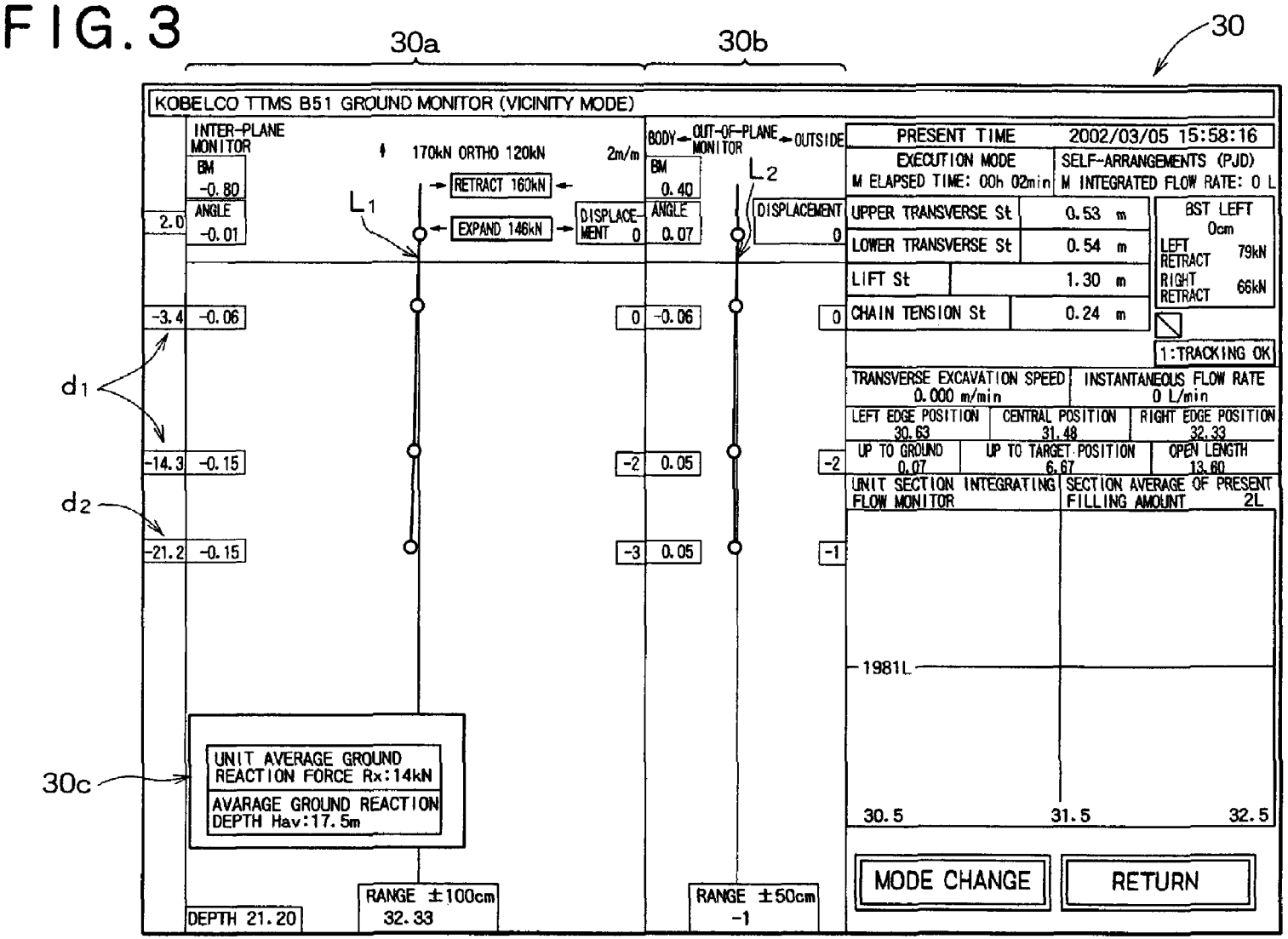
FIG. 3 is a view showing a screen for an execution mode displayed on a monitor of FIG. 2.

FIG. 3 illustrates an execution mode display on the screen of the monitor 21. On the left-hand side of a display 30 of the monitor 21 is disposed an intra-plane monitor section 30*a*, while centrally thereof is disposed an out-of-plane monitor section 30*b*.

At a left end of the intra-plane monitor section 30*a* are displayed inclinometer installation depths (indicated as $d_1$, $d_2$), while at a lower end thereof is displayed the present depth.

Further, angles measured by an inclinometer of a base machine body of the excavator and an inclinometer mounted on a drive unit are displayed respectively and displacements are displayed on the right-hand side thereof.

If the positions of the inclinometers are represented by ○ marks, a ground excavation line L1 is displayed by a straight line joining those marks.

The ○ marks shift laterally upon lateral displacement of the cutter post 6, and the ground excavation line L1 also shifts accordingly.

In the intra-plane monitor section 30*a*, if excavation is performed rightwards, the right-hand side with respect to the ground excavation line L1 is painted out with a color which represents the ground, e.g., brown color, which the left-hand side as an already trenched side is painted out with beige color for example. Of course, an area below the lower end or the bottom of the cutter post 6 is also painted out with brown color since the area shows the unexcavated ground.

In this way a boundary surface between an excavated area and an unexcavated area is displayed visually. A point where the excavation bits excavate newly is detected by the position measuring instrument 19. As a result, excavation energy and excavation volume at the excavation point are calculated. Excavation energy is determined from outputs of the transverse cylinders 13, 14, the lift cylinders 15, 16, and a hydraulic motor of the rotation drive unit 8. On the other hand, excavation volume is determined from a difference between the shape of a boundary surface at the beginning of excavation and that at the end of excavation.

Using excavation volume, excavation time, and bit load, the strength of the ground can be determined with high accuracy on the basis of the theory of infinitesimal notch. Further, data of a strain meter can be utilized as means for enhancing the accuracy of bit load.

On the other hand, in the out-of-plane monitor section 30*b*, the left-hand side of a straight line L2 represents the machine body side of the trench excavator and the right-hand side represents the outside of the excavator.

Angles measured by the inclinometer of the base machine body and the inclinometer of the drive unit are displayed on the left-hand side and displacements are displayed on the right-hand side.

In a range 30*c* at a left lower position on the screen, there are numerically displayed a unit average ground reaction force Rx [kN] and an average ground reaction depth Hav [m].

The values of Rx and Hav serve as evaluation indices for the foregoing ground change.

Figure 4:
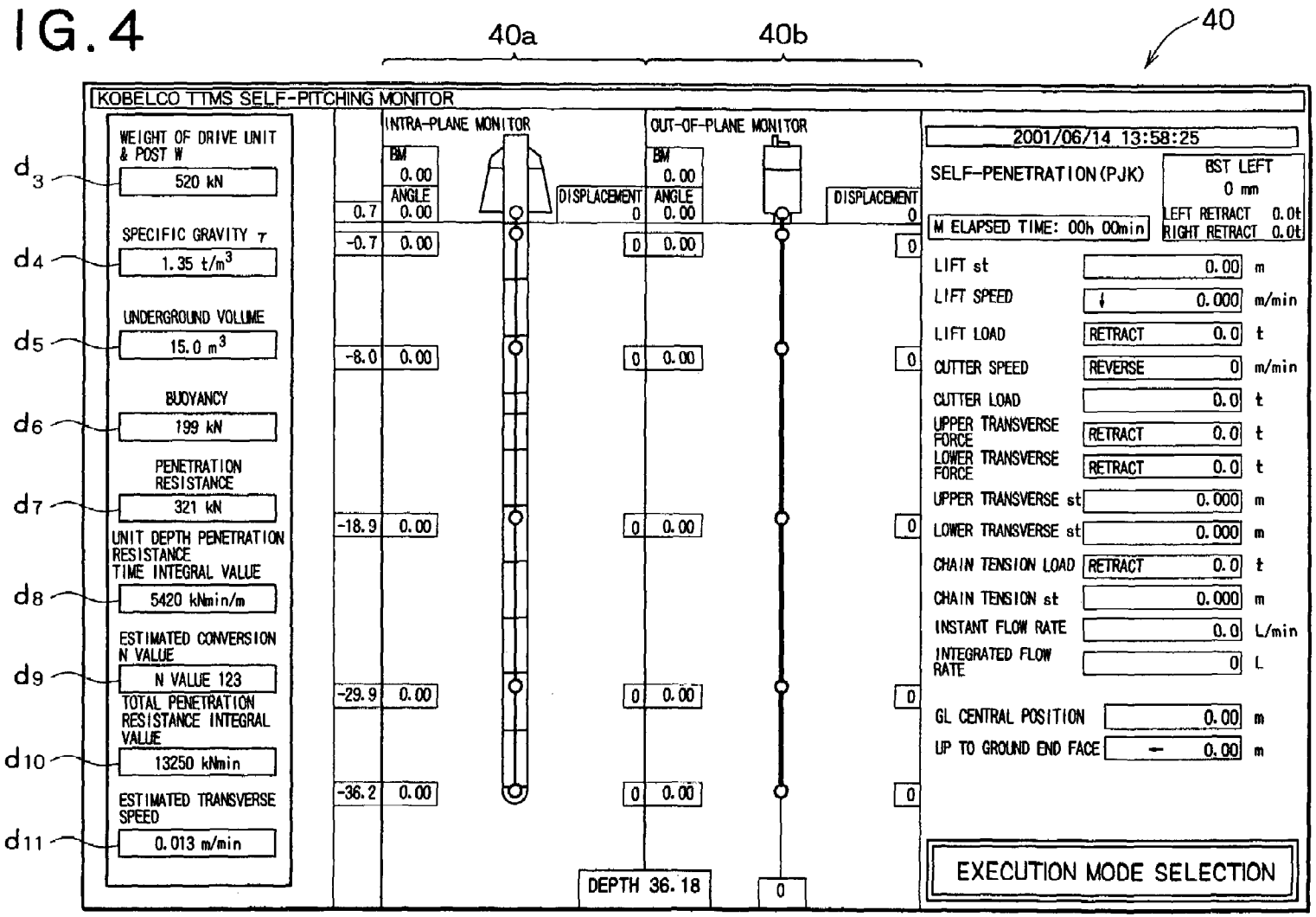
FIG. 4 is a view showing a screen for a self-penetration displayed on a monitor of FIG. 2.

FIG. 4 illustrates a self-penetration display.

In an intra-plane monitor section 40*a* on the left-hand side of a monitor screen 40, there are displayed a state of underground penetration of the cutter post 6 and a penetration depth.

Various values obtained upon penetration of the cutter post are displayed at the left end of the screen. To be more specific, weight W of the drive unit and the cutter post is displayed in d3, a specific gravity γ is displayed in d4, an underground volume Vc of the cutter post is displayed in d5, buoyancy acting on the cutter post is in d6, a penetration resistance is in d7, a unit depth penetration resistance time integral value is in d8, a converted N value is in d9, a total penetration resistance integral value is in d10, and an estimated transverse (horizontal) excavation speed is in d11.

The weight W of the drive unit and the cutter post is necessary for the calculation of penetration resistance as noted earlier. The specific gravity γ is necessary for the calculation of buoyancy of the cutter post 6. The underground volume Vc is necessary for specifying an underground portion of the cutter post in the buoyancy calculation.

From these values, there are determined buoyancy, penetration resistance Fz, and total penetration resistance integral value FzH, and there eventually is determined an estimated transverse speed Vxav which serves as an index in horizontal excavation.

Thus, in the continuous underground trench excavating method according to the present invention comprising vertical excavation with a cutter post equipped with an excavating means being inserted into the ground and horizontal excavation with a cutter post-supporting base machine being moved horizontally, wherein the continuous underground trench is formed by both the vertical excavation and the horizontal excavation, a penetration resistance is determined while the cutter post is penetrated to a predetermined depth, then a ground strength in the depth direction is estimated on the basis of the penetration resistance, and excavation is carried out with a thrust matching the estimated ground strength.

According to this method, a penetration resistance is determined during penetration of the cutter post, then a ground strength in the depth direction is estimated, and excavation is carried out while making reference to the estimated value, so that it is possible to effect an appropriate excavation taking properties of the ground into account.

In this method, if excavation energy required for unit depth is determined on the basis of penetration resistance, it is possible to effect excavation matching the capacity of the continuous trench excavator.

Moreover, by estimating N value as a ground strength value from the excavation energy, it is possible to obtain N values in all of excavated sections. Consequently, the ground condition can be evaluated more accurately than in the conventional method wherein excavation is carried out in accordance with some N values obtained by a boring survey.

The N values are values obtained by a standard penetration test, and, from a distribution of the N values in the depth direction, it is possible to grasp high and low portions of ground strength in the excavation depth range.

An average depth under a ground reaction force in the horizontal direction is calculated on the basis of a converted N value, then an average ground reaction force in the horizontal direction is calculated from the average depth, further, a projected excavation area in a vertically downward direction and a projected excavation area in horizontal excavation are calculated, and an excavation speed in horizontal excavation is calculated from the foregoing relation between a surface pressure, or a contact pressure, acting on the projected excavation area and the excavation speed, whereby a horizontal excavation speed can be estimated from the result of a vertical excavation speed. Consequently, it becomes easier to make a execution plan.

Further, by calculating a ground reaction force in horizontal excavation with the cutter post, calculating excavation energy at a unit horizontal distance from the ground reaction force, and thereby carrying out excavation while measuring an excavation load, there is obtained an energy quantity spent in horizontal excavation while carrying out the excavation. Thus, the state of the horizontal excavation can be grasped easily on the basis of a change in the excavation energy.

If excavation is controlled so that a variation quantity of excavation energy at a unit horizontal distance which is calculated with the lapse of time of horizontal excavation falls under a predetermined range, it is possible to excavate a continuous trench of a constant quality even if the state of the ground changes.

Further, if the cutter post is moved horizontally in its inserted state into a bearing layer to effect trenching and if the cutter post is controlled in the depth direction so that a variation quantity of excavation energy at a unit horizontal distance falls under a predetermined range, a continuous trench of a constant depth can be excavated following a bearing layer such as a water-permeable layer or the ground even if the level of the bearing layer varies vertically.

If adjustment is made in excavation when a variation quantity in excavation energy at a unit horizontal distance is deviated from a predetermined range, it is possible to effect excavation without giving rise to an overload.

According to the present invention, there also is provided a continuous underground trench excavator for forming a trench continuously by vertical excavation with a cutter post equipped with an excavating means inserted into the ground and horizontal excavation with a cutter post-supporting base machine being moved horizontally, the continuous underground trench excavator comprising a penetration resistance calculating means for determining a penetration resistance under penetration of the cutter post to a predetermined depth, an excavation energy calculating means for calculating excavation energy for unit depth on the basis of the penetration resistance, a ground strength estimating means for estimating a ground strength in the depth direction from the excavation energy, and an excavation control means for carrying out excavation with a thrust matching the estimated ground strength.

According to this trench excavator, the penetration resistance is determined while the cutter post is penetrated to the predetermined depth, then the ground strength in the depth direction is estimated on the basis of the penetration resistance, and the excavation is carried out with the thrust matching the estimated ground strength. Consequently, it is possible to effect an appropriate excavation while grasping properties of the ground or the ground condition.

Although an embodiment of the present invention has been described above, the scope of protection of the present invention is not limited thereto.

What is claimed is:

1. A continuous underground trench excavator comprising:

a trencher having an excavating element;

a travel body which supports said trencher vertically movably, said travel body causing said trencher to move substantially vertically and substantially horizontally to form a continuous trench;

a penetration resistance calculating means for calculating a penetration resistance under penetration of said trencher to a predetermined underground depth;

a ground strength estimating means for estimating a ground strength in a direction of the underground depth from said penetration resistance; and an excavation control means for making control so that excavation is carried out with a thrust matching the estimated ground strength.

2. The continuous underground trench excavator according to claim 1, further comprising:

an excavation energy calculating means for calculating excavation energy for unit depth on the basis of said penetration resistance, and wherein said ground strength estimating means estimates said ground strength from said excavation energy.

3. The continuous underground trench excavator according to claim 1, wherein said trencher is a cutter post having said excavating element.

4. A continuous underground trench excavating method using the continuous underground trench excavator of claim 1, comprising the steps of:

determining a penetration resistance with use of said penetration resistance calculating means under penetration of said trencher to a predetermined depth;

estimating a ground strength in a direction of the underground depth on the basis of said penetration resistance; and performing vertical excavation in which said trencher is inserted into the ground with a thrust matching the estimated ground strength and horizontal excavation in which said travel body is moved substantially horizontally to allow said trencher to perform excavation in a horizontal direction, thereby to form a continuous trench.

5. The continuous underground trench excavating method according to claim 4, further comprising the step of:

determining excavation energy required for unit depth on the basis of said penetration resistance, wherein, from the excavation energy, a ground strength is estimated in the direction of the underground depth.

6. The continuous underground trench excavating method according to claim 5, wherein an N value which represents the ground strength is estimated from said excavation energy as an estimated N value.

7. The continuous underground trench excavating method according to claim 6, further comprising the steps of:

calculating an average depth under a horizontal ground reaction force on the basis of the estimated N value;

calculating an average horizontal ground reaction force from the average depth;

calculating a projected excavation area in a vertically downward direction and a projected excavation area in horizontal excavation; and estimating an excavation speed in horizontal excavation from a surface pressure acting on said each projected excavation area and an excavation speed.

8. The continuous underground trench excavating method according to claim 4, wherein a ground reaction force in horizontal excavation by said trencher is calculated and excavation energy at a unit horizontal distance is calculated from said ground reaction force to measure an excavation load and perform excavation simultaneously.

9. The continuous underground trench excavating method according to claim 8, wherein the excavation is controlled so that a varying quantity of the excavation energy at said unit horizontal distance which is calculated with the lapse of time on the basis of the horizontal excavation falls under a predetermined range.

10. The continuous underground trench excavating method according to claim 9, wherein said trencher is moved horizontally with said trencher inserted into an underground supporting layer to effect trench excavation, and said trencher is controlled in a depth direction so that the varying quantity of excavation energy at said unit horizontal distance falls under the predetermined range.

11. The continuous underground trench excavating method according to claim 9, wherein an adjusting excavation is performed when the varying quantity of excavation energy at said unit horizontal distance deviates from the predetermined range.

* * * * *